US012774601B2

(12) United States Patent
Sostaric

(10) Patent No.: US 12,774,601 B2
(45) Date of Patent: Oct. 27, 2026

(54) METHOD FOR SUPPORTING A RESIDENTIAL STRUCTURE TO COMPLY WITH CODE RESTRICTIONS RELATIVE TO BASE FLOOD ELEVATION

(71) Applicant: Joseph Sostaric, Danville, CA (US)

(72) Inventor: Joseph Sostaric, Danville, CA (US)

( * ) Notice: Subject to any disclaimer, the term of this patent is extended or adjusted under 35 U.S.C. 154(b) by 0 days.

(21) Appl. No.: 18/524,387

(22) Filed: Nov. 30, 2023

(65) Prior Publication Data

US 2025/0059765 A1 Feb. 20, 2025

Related U.S. Application Data

(60) Provisional application No. 63/420,957, filed on Oct. 31, 2022.

(51) Int. Cl.
*E04C 2/04* (2006.01)
*E02D 1/02* (2006.01)

(52) U.S. Cl.
CPC ..... *E04C 2/044* (2013.01); *E02D 1/02* (2013.01)

(58) Field of Classification Search
CPC ..... E04C 2/044; E02D 1/02; E04H 9/145
See application file for complete search history.

(56) References Cited

U.S. PATENT DOCUMENTS 3,396,624 A * 8/1968 Eriksson ..... F16B 15/04 411/922
10,948,929 B1 * 3/2021 Pierce ..... G05D 9/12
11,532,093 B2 * 12/2022 Mantey ..... G06T 7/62
2004/0074201 A1 * 4/2004 Camilleri ..... E02D 27/50 52/741.11
2014/0290154 A1 * 10/2014 Perko ..... E04H 9/145 52/126.5
2018/0142461 A1 * 5/2018 Kelly ..... E03B 11/02
2018/0347265 A1 * 12/2018 Bolt ..... E04H 9/16
2020/0095742 A1 * 3/2020 Sheridan ..... E02B 3/108
2020/0165809 A1 * 5/2020 Cohen ..... E04C 2/384
2020/0256119 A1 * 8/2020 Dahl ..... E04H 9/145
2020/0348132 A1 * 11/2020 Du ..... G01C 5/00
2021/0110564 A1 * 4/2021 Mantey ..... G06T 3/40
2021/0189675 A1 * 6/2021 Mitchell ..... E02B 3/102
2021/0316475 A1 * 10/2021 Diver ..... B28C 7/0418
2022/0081926 A1 * 3/2022 Yano ..... E05F 15/67
2022/0268047 A1 * 8/2022 Zhang ..... E06B 5/10
2022/0325549 A1 * 10/2022 Farmer ..... E04H 9/145

* cited by examiner

*Primary Examiner* — Paola Agudelo
(74) *Attorney, Agent, or Firm* — Mark Lawrence Lorbiecki

(57) ABSTRACT

A method and a resulting PLDCC slab formed by that method results in elevating the lowest floor (LFE) of a proposed structure to be built on a selected building site to a height at or above the base flood elevation (BFE) as each term is defined under 44 CFR 60.3. The BFE is retrieved from the Flood Insurance Rate Map (FIRM) by locating the building site thereon. The proposed structure defines the LFE. With a height of the existing grade beneath the LFE, a difference between the BFE and the height of the existing grade beneath the LFE determines a PLDCC height. A form constructed to contain a volume of cellular lightweight concrete (PLDCC) having a PLDCC height that equals the difference. A pour of sufficient PLDCC volume then fills the form to a depth at the LFE equal to or exceeding the PLDCC height.

10 Claims, 4 Drawing Sheets

METHOD FOR SUPPORTING A RESIDENTIAL STRUCTURE TO COMPLY WITH CODE RESTRICTIONS RELATIVE TO BASE FLOOD ELEVATION

FIELD OF INVENTION

This disclosure relates to the field of exploitation of cellular concrete and, more particularly, to systems and methods for employing cellular concrete as foundational engineered fill.

RELATED APPLICATIONS

The instant invention claims priority to the Provisional Application entitled, "A Method for Supporting Structures with Cellular Concrete," filed with the United States Patent and Trademark Office on Oct. 31, 2022 and receiving Ser. No. 63,420,957.

BACKGROUND

The devastating effects of Hurricane Ian have, once again, brought to the forefront the damage imparted by storm-incited flooding upon the low-lying areas that exist in coastal areas. Coastal floods come from storms of tremendous energy originating in either of Atlantic or Pacific Oceans, the Gulf of Mexico or in large lakes (such as the Great Lakes), bays, including tidal rivers that are big enough to have large waves or that can be affected by storm surge. Coastal floods can be very dangerous when high waters are combined with the destructive forces of waves. In low-lying coastal areas, storm surge and flooding can reach many miles from the shoreline, flowing up rivers and across flat land. For example, in the state of Florida, hurricanes and the attendant flooding that follows can be the cause of millions of dollars of damage to businesses and residences located there.

As FIGS. 1A and 1B attest, Florida's topography is flat throughout the state putting a huge amount of the population at risk for a major flooding event. The FIG. 1A on the left shows a topographic view of Southern Florida where the map on the right shows the elevations of the topography where the dark blue area is land that is an elevation of 16' or less and the light blue area is property that is 32' or less. All the major coastal cities in South Florida are predominantly at elevations that are less than 32'. Recent studies indicate that this issue will only be exacerbated by the effects of sea level rise and climate change which are expected to only increase the potential for catastrophic flooding.

The National Flood Insurance Program (NFIP) is managed by the Federal Emergency Management Agency (FEMA) and is delivered to the public by a network of more than 50 insurance companies and the NFIP Direct. The NFIP provides flood insurance to property owners, renters and businesses, and having this coverage helps them recover faster when floodwaters recede. The NFIP works with communities required to adopt and enforce floodplain management regulations that help mitigate flooding effects.

FEMA defines the Base Flood Elevation (BFE) as the computed elevation to which the flood is anticipated to rise during the base flood. The base flood is also referred to as the 1-percent annual chance flood or 100-year flood. A 1-percent annual chance flood means that, statistically, there is a 1% chance every year that there will be a flood at that elevation. The one-hundred-year flood is, in part, a misnomer. Once an elevation is defined as such, there is no certainty as to that one-hundred-year interval. Conditions are such that it could flood fewer, or more, or, indeed, many times a year, or not at all. The BFE is a baseline pulled together from historic weather data, local topography, and the best science available at the time. It is a reasonable standard to insure against, but it is not a guarantee that it will flood only 1 time every 100 years and the flood will look exactly like it does on the maps FEMA generates to lay out BFE contours.

The BFEs shown on FEMA's Flood Insurance Rate Maps (FIRMs) and in the Flood Insurance Study (FIS) are published by the Map Service Center for almost every community. The land area covered by the base flood is called the Special Flood Hazard Area (SFHA) on FEMA's maps. The SFHA is the area where the National Flood Insurance Program's (NFIP's) floodplain management regulations must be enforced and the area where the mandatory purchase of flood insurance applies. The SFHA includes flood Zones A, AO, AH, A1-30, AE, A99, AR, AR/A1-30, AR/AE, AR/AO, AR/AH, AR/A, VO, V1-30, VE, and V. Structures sited in one of those zones are regulated by federal as well as state and local regulations as to feasibility of construction and the subsequent insurance of constructed structures. By way of example, three zones are laid out in FIG. 1 hereto: VE, AE, and X. FIG. 2 also sets out four other designations that are unique to coastal areas for the FIRMs.

A Coastal High Hazard Area (CHHA) is an area of special flood hazard extending from offshore to the inland limit of a primary frontal dune along an open coast and any other area subject to high velocity wave action from storms or seismic sources. CHHAs are indicated as V or VE zones on the Flood Insurance Rate Maps. These parts of the coastal SFHA are called "V zones" and they show areas where waves and fast-moving water can cause extensive damage during the base flood event. In V zones, wave heights are larger than 3 feet. "Zone VE" means that a detailed study has been done for the area, and BFEs have been calculated. The label "Zone V" means that a detailed study has not been done for the area. BFE data is not available, but wave hazards are still expected. Structures in areas mapped as Zone V and Zone VE are subject to stricter building requirements because of the higher risk of damage from strong waves.

FIRMs designate zones by contours defining the limit of moderate wave action (LiMWA). The LiMWA marks the inland limit of the "Coastal A Zone," a term referenced by building codes and standards. The Coastal A Zone is the part of the coastal SFHA where wave heights can be between 1.5 and 3 feet during the base flood event. Because of the higher risk of damage to homes and other structures from waves in the Coastal A Zone, FEMA encourages the practice of building to Zone V standards within this area. Many local building codes require that buildings in the Coastal A Zone be built to Zone V standards. However, the LiMWA does not impose any additional National Flood Insurance Program (NFIP) regulations.

"Zone AE" is used to label parts of the SFHA on flood maps in coastal and non-coastal areas. In coastal areas, AE zones indicate areas that have at least a 1-percent-annual-chance of being flooded and wave heights are less than 3 feet. For Zone AE, detailed analyses have been performed and BFEs have been calculated.

"Zone AO" shows areas at risk of flooding during the base flood, where water 1 to 3 feet deep flows over sloping ground. On coastal maps, Zone AO usually marks areas at risk of flooding from wave overtopping, where waves are expected to wash over the crest of a dune or bluff and flow into the area beyond. In AO zones, flood depth is expressed as a height above natural ground. Homes and other buildings in these areas are still vulnerable to flooding from waves, even if they are on higher ground or behind a wall or other structure.

Additionally, areas of moderate wave action (MoWA); minimal wave action (MiWA) and no wave action are set out. These alternate terms for coastal zones are, of course, merely explanatory in nature but are used to explain differences between VE, AE, and X zones on the FIRM.

Typically, when an applicant applies to the local (generally county government) for a building permit for a structure to be sited in a Special Flood Hazard Area, applicant is required to provide a pre-construction elevation certificate that confirms the vertical height requirement for flood protection. Among other things, the floor elevation of the new home must be 2 feet above the base flood elevation as established by a professional surveyor. Floor elevation will be verified during the home's floor framing or manufactured home's blocking inspection. Also, the foundation must contain flow through vents for the passage and draining of flood water. Later, an as-built elevation certificate must be completed by a professional surveyor. This is additional information gathered from the surveyor's inspection of the completed home. For this reason, elevation of the structure above the BFE is an essential design objective in proposing such structures.

While not limited to coastal areas, most lands within designated flood plains is, by its nature, soft soil and building structures on soft soil is very challenging. For instance, large consolidation and post-construction creep settlement tend to be major issues in such a structure. In addition, low bearing capacity, poor construction conditions, relocation of buried utilities, and potential settlement damage to adjacent structures and foundations are also common issues that must be addressed in the construction and design of structures in such areas.

Efforts to alter foundation conditions with some form of ground improvements or by constructing deep foundations (e.g., piles, shafts, etc.) for stilted structures to bring the structure above the BFE have presented several challenges. For instance, construction of deep foundation systems slows down construction as loading (i.e., surcharging) of approach fills and waiting for consolidation of the foundation soil require considerable time and effort before completing final construction. To properly compact soil, multiple lifts are required. A typical recommendation is to allow only 8" lifts at a time.

In urban areas, local authorities might allow constructors to bring in materials to raise the grade. Returning to Florida as a non-limiting example, an aggregate base material is imported to the site as a product known as Road Base which is a combination of shell, crushed shell, and sand A surcharge load, typically consisting of fill material, placed on the design platform. Road Base is equipment and labor intensive to place. Multiple truck loads must be hauled into the site and people and equipment must be brought in to place it. Also, the placement of aggregate exerts pressures on the underlying soft soil and creates development of excess pore water pressures that are slow to dissipate due to the low permeability of these soft soils. A "surcharge" on a retaining wall is any load in addition to level grade within that area defined by a 45-degree angle from the bottom of the footing to level grade. Because of the remediation of these surcharge loads, construction is far more expensive than it might be without the remediation in terms of time and labor. In addition, while the construction of a deep foundation system can decrease the likelihood of undesirable settlement of the structure itself, the construction of the associated earthen embankment increases the likelihood of collateral damage or having to relocate buried utilities and facilities.

A need exists for an improved method for elevating and stabilizing above-grade construction to be compliant with all the statutory and regulatory requirements placed due to specifications set out to implement the NFIP.

SUMMARY OF THE INVENTIVE METHOD

In an embodiment, a structural support system includes a support embankment formed from permeable low-density cellular concrete and arranged to support and be positioned under a footing of a structure.

The method and resulting PLDCC slab formed by that method results in elevating the lowest floor (LFE) of a proposed structure to be built on a selected building site to a height at or above the base flood elevation (BFE) as each term is defined under 44 CFR 60.3. The BFE is retrieved from the Flood Insurance Rate Map (FIRM) by locating the building site thereon. The proposed structure defines the LFE. With a height of the existing grade beneath the LFE, a difference between the BFE and the height of the existing grade beneath the LFE determines a PLDCC height. A form constructed to contain a volume of permeable low-density cellular concrete (PLDCC) having a PLDCC height that equals the difference. A pour of sufficient PLDCC to fill the form to a depth at the LFE equal to or exceeding the PLDCC height.

DETAILED DESCRIPTION OF THE INVENTIVE METHOD

Figure 1A:
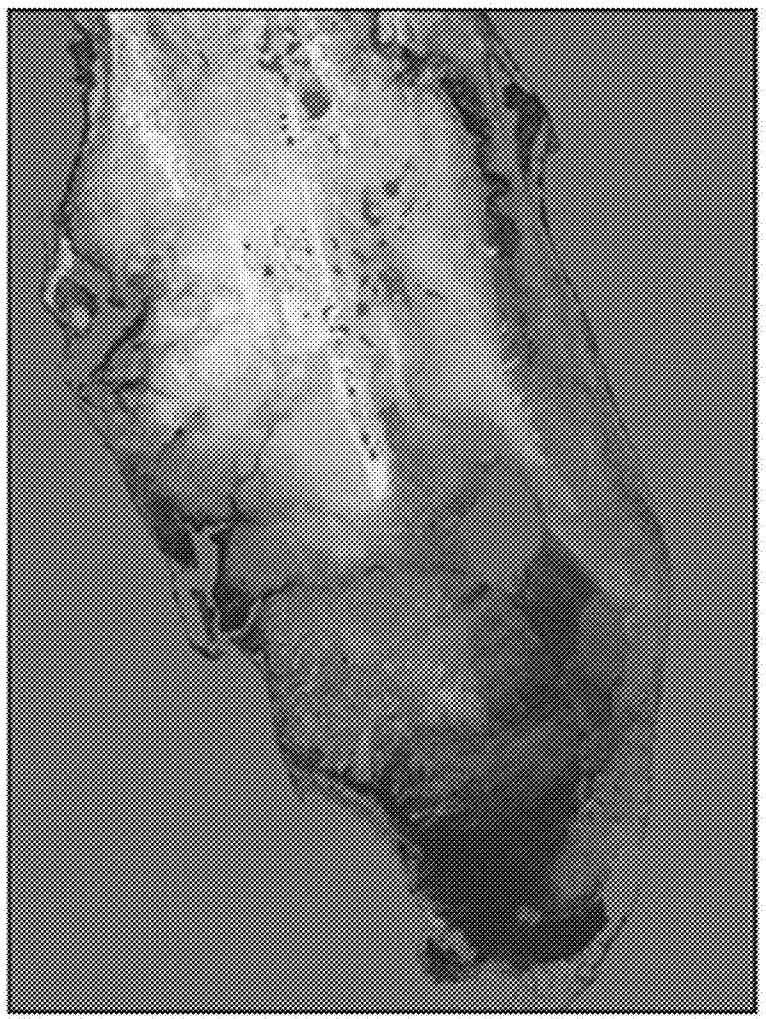
FIGS. 1A and 1B depict a map of southern Florida, 1A to show terrain elevation relative to sea level; 1B showing elevations at five or fewer meters and those of between five and ten meters.
Figure 1B:
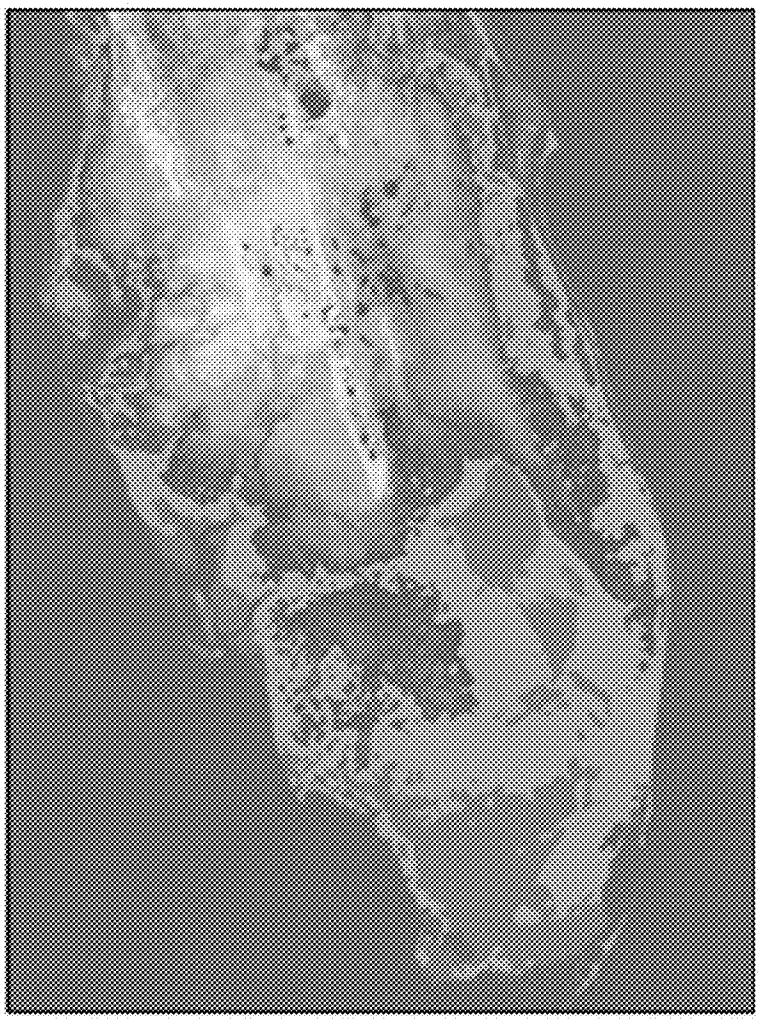
Figure 2:
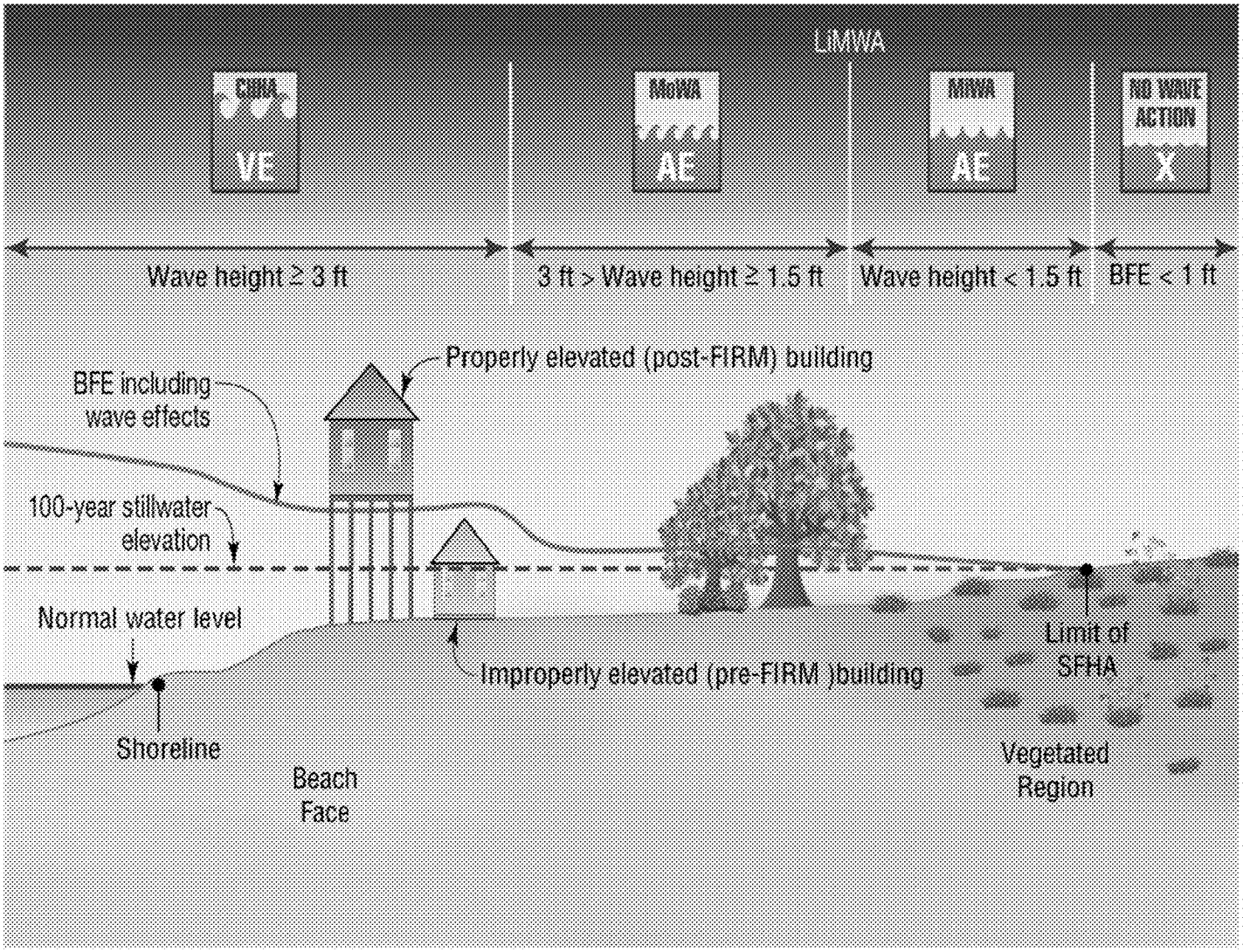
FIG. 2 depicts a pictorial view of coastal classification relative to NFIP.

A typical build-up of a ground supported floor includes several layers of materials and components: concrete slab, slip membrane, subbase, and subsoil. In some instances, the ground supported floor will include an insulation layer between the slab and subbase such as where radiant heat is employed to warm the structure. Usually, the insulation layer is chosen as hard extruded styrene boards, while the subbase is formed of lean concrete or compacted gravel.

Permeable low-density cellular concrete (PLDCC) is defined as concrete made with hydraulic cement, water, and preformed foam to form a hardened material having an oven-dry density of 50 lb/ft$^3$ (800 kg/m$^3$) or less. These mixtures may include aggregate and other material components including, but not limited to, fly ash and chemical admixtures. The basic materials in low-density cellular concrete are cement, water, and preformed foam. Because the main ingredient by volume of a low-density cellular concrete mixture is preformed foam, it is critical that all admixtures be compatible with the preformed foam within the specific mixture. The cement should meet the requirements of ASTM C 150 (Portland cement), C 595 (blended cement), or C 1157 (hydraulic cement). Blended cements include cement containing combinations of Portland cement, pozzolans, slag, other hydraulic cement, or some combination of these.

Because it is both less dense than such conventional materials as road base and does not require compaction to become stable, PLDCC presents itself as a possible solution obviating the need for conventional site preparation. Still further, in terms of sheer volume of material to be transported to remediate the site, the voids the foam comprises displaces material that would otherwise be necessary to shore up the structure. According to the American Concrete Institute (ACI), proportions within the mixture of cement, water, and pre-formed foam define PLDCC. The basic purpose of foam formation in concrete is to create air voids within cement mortar paste and thus to lower the density of the final mix while retaining the strength of concrete. The density of the mix can vary from 400-1850 kg/m$^3$, according to the dosage of foam used. In such densities, the PLDCC is suitable for the ends of the instant invention.

PLDCC is an exceptional form of concrete, where stable foam molds the structure of the concrete by inundating the concrete matrix with foam bubbles. The distinctiveness of PLDCC includes the absence of coarse aggregates in favor of air-filled voids. In foamed concrete or PLDCC, cement may be ordinary Portland cement, rapid hardening cement or high alumina cement as any may be used primarily as a binder, which can be up to 25-100% in volume. Other supplementary materials such as fly ash, silica fume, bottom ash or lime can also be used with cement from 10-75%.

Although the foamed concrete was first patented in 1923 and, here, no claim is made to the constituent ingredients in PLDCC nor to the formation of PLDCC, this application seeks to protect the use of PLDCC for a foundation substrate for residential structures. Foamed concrete is selected for the application based upon its lightweight behavior, as it minimizes the dead load of the structure, which directly reduces loads on the column and hence foundation.

PLDCC has other attributes making it suitable to support residential structures. The high flowability of PLDCC is useful in pumping applications avoiding those voids that might be caused by stiff concrete failing to flow into angled features in foam. PLDCC has lower cement content compared to conventionally poured concrete thereby allowing it to inundate all aspects of the foam.

The excellent thermal insulation capacity allows the presence of air in the PLDCC to obviate the need for any insulation layer in the setup of the foundation. The values PLDCC presents as to thermal conductivity lie in between 0.1 to 0.7 W/mK for the dry density of 600-1600 kg/m$^3$, respectively. In contrast, the thermal conductivity of regular concrete is over twice that at nearly 1.6 W/mK at a density of 2200 kg/m$^3$. Additionally, PLDCC absorbs sound well and lends fire resistance properties to the resulting structure. PLDCC with densities 950 kg/m$^3$ to 1200 kg/m$^3$ can withstand fire for 3.5 hours and 2 hours, respectively.

In designing a mix for use as substrate or embankment, the qualities of the resulting PLDCC relies upon factors associated with the strength and shrinkage behavior of foamed concrete, such as the selection of foaming agent, method of foam production, distribution of air voids, type of cement, size of aggregate, water-cement ratio, the volume of foam, use of plasticizer, and use of other constituent materials such as silica fume, fiber etc.

The strength of foamed concrete is mostly affected by the foam content and not the water-cement ratio. In contrast, the proportion of water in the mix is important in another way, as lower water content causes the mixture to be overly stiff for generating PLDCC. Where too stiff a mix of concrete is employed, bubbles within the foam break during mixing, which consequently causes increase in PLDCC density. Similarly, more water content causes the slurry to be too thin to hold the bubbles, which causes segregation of foam from the concrete mix. Generally, the water to cement ratio should be between 0.4 to 1.25 or in the range of 6.5-14.5% of the target density.

Small size ingredients particles with low specific gravity are favorable to produce high strength lightweight foamed concrete. Whereas the use of large size aggregate lowers the value compressive and tensile strength. In the proposed application, the smaller aggregate tends to be more available where PLDCC is used as a substrate. The substitution of coarse sand in place of fly ash in foamed concrete increases the compressive strength up to 30%. Similarly, the addition of finer silica particles up to 10% helps to increase the compressive strength of the foamed concrete from 5.5 Mpa to 9.2 Mpa.

Considerations in designing the mix for the application includes selection of the constituent ingredients in the mix. For example, a 40% improvement in strength can be achieved when 43-grade cement was replaced with 53-grade cement in PLDCC. Lower density foam ≤30 kg/m$^3$ has a high particle holding capacity and good stability. Such a mix of PLDCC creates small-size pores in foamed concrete, resulting in high compressive strength. Still further, addition of a small amount of fiber up to 1% improves the strength of foamed concrete. The fiber also helps to resist the formation of vertical cracks, thereby allowing the specimen to sustain some additional load before the crushing. Smaller size aggregate ≤1.18 mm helps to increase the strength of PLDCC. But, smaller size aggregate also increases the shrinkage of the formed, cured PLDCC.

Generally, the cost of hauling aggregates across distances of 48-80 km (30-50 miles) can double the overall cost of the aggregates. Moreover, the cost of aggregate transport in congested urban areas can be three to four times as expensive. Further, in addition to these costs and environmental impacts, the weight of thick aggregate layers is a burden to weak soils. For the example, the use of permeable low-density cellular concrete (PLDCC) as an aggregate replacement in raising the grade level in flood zones can significantly cut aggregate transport costs while improving permeability of the resulting grade structure allowing the rapid drainage of otherwise flooded substrate structures. So, in an exemplary application, if 50% of the aggregate layer is replaced with PLDCC, a saving of approximately 300 truck trips could be achieved because the PLDCC needs no aggregates and approximately 850 tons of cement (⅙th of the aggregates weight) is sufficient to construct the exemplary permeable grade structure comprising 2500 m$^3$ of PLDCC.

The American Concrete Institute (ACI) 523 defines lightweight (or low-density) cellular concrete as "a mixture of cement, water, and preformed foam." The synthetic foam used in PLDCC resembles a shaving foam, which contains internal microscopic pores. When the foam is mixed with cement and water, the air voids in the foam make up a significant volume in the resulting mix and, thus, provides a porous texture once the liquid concrete has hardened into a solid. Moreover, the PLDCC uses no coarse aggregates eliminating the need to haul aggregates (Montemayor et al.). In addition, PLDCC has numerous advantages such as superior thermal properties, freeze-thaw resistance, cost-effectiveness, ease of construction, and economy of transportation. Hence, PLDCC is widely used in buildings such as precast architectural panels, partition walls, noise-abatement structures, masonry blocks, and ground stabilization structures. However, there are few studies on design and construction guidelines for the use of PLDCC in parking lots and roads.

The resulting substructure is superior to conventional permeable grade structure. Averyanov (2018) investigated the long-term performance of PLDCC as an alternate to aggregate subbase layers in highways. The study concluded that the pavement with the PLDCC subbase was more durable than the road with granular aggregate materials of the same thickness.

The strength and permeability of PLDCC are mainly derived from its density. The density of PLDCC used in various construction applications ranges from 300 to 1800 kg/m$^3$. The choice of PLDCC with densities of between 300 and 600 kg/m$^3$ provides soil stabilization. However, as the recommended density of PLDCC is half that of water, there can be significant buoyant forces when water percolates into the PLDCC layer, thus causing damage to the permeable paving. Hence, in some embodiments, rather than replacing the entire aggregate reservoir layer, only some selected portion of the aggregate is replaced with PLDCC.

In substituting PLDCC for various layers of concrete and aggregates designed in the inventive elevating grade structure, the main difference from that of a existing conventional grade structure is the need for strength to withstand structure loads along with the requisite permeability for good run-off storage. The permeability depends on the void content of the layer, and the storage capacity depends on both the void content and layer thickness. In general, surface layer with around 20% air voids exhibits appropriate compressive strengths. Meanwhile, the aggregate layer thickness depends on the hydrologic design, loading, and frost depth. In most embodiments, an aggregate layer should be composed of clean, open-graded aggregate with no fines, while a void space of 36-42% and a minimum thickness of 300 mm-450 mm are recommended in cold climates.

In permeable paving designed with PLDCC, a surface overflow during rainfall events may arise due to a sudden change in permeability at the interface between different layer materials.

PLDCC is a mixture of cementitious materials (Portland cement and pozzolan materials), water, a stable preformed foam, and, in some cases, fine aggregates such as sand. Unlike the Portland cement concrete, there are no standard mix design procedures for PLDCC. In general, a cement slurry or mortar is first prepared, and a preformed foam is then added. The density of PLDCC is verified against the target density (e.g., 400 or 500 kg/m$^3$). If the verified density of PLDCC is higher than the targeted density, then additional foam is added and mixed thoroughly, and the density is verified again. This process continues until the mix yields the required density.

The water-to-cement ratio (W/C) and cementitious content both affect the strength of the PLDCC. In the present study, a W/C ratio of 0.5 was used along with the following two types of cementitious material: (i) 100% Type I Portland cement, and (ii) a 50:50 blend of Type I Portland cement and Class C fly ash. To produce the PLDCC, one such foaming agent such as the conventionally available AQUAERiX™ foam concentrate may be diluted with water in the proportion of 1:40. The diluted solution was then converted into a fine micro-bubbled foam by being discharged the solution through a foam generator (compressed air equipment).

Figure 3:
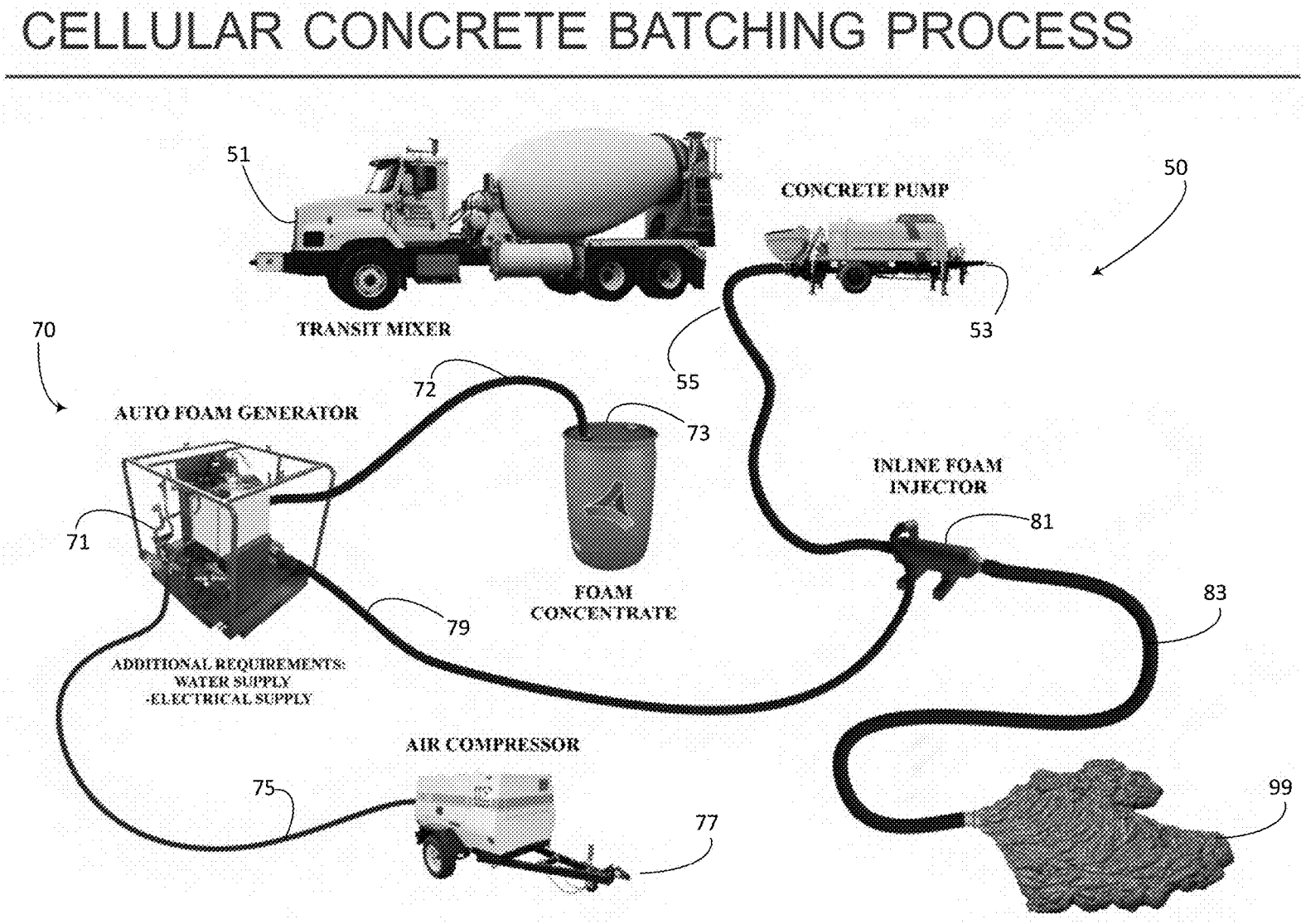
FIG. 3 depicts the apparatus used in conventional preparation of cellular low-density concrete.
Figure 4:
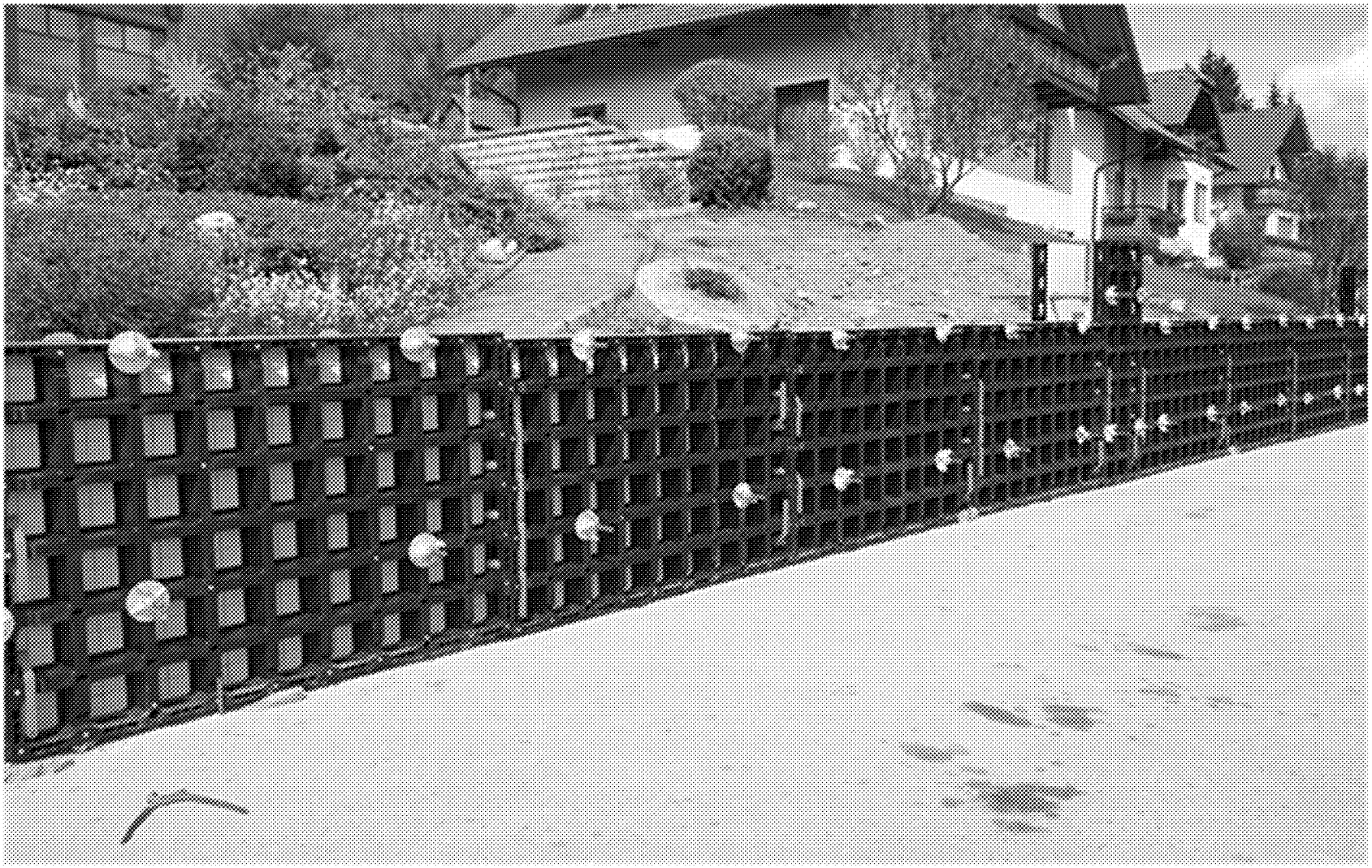
FIG. 4 depicts the erection of forms for pouring a cellular concrete subbase to set a lowest floor elevation above the base flood elevation.

Referring to FIG. 3, the conventional apparatus 50 to generate PLDCC 99 relies upon diluting a liquid foam concentrate 73 (fed through a foam line 72) with water (generally supplied by a hydrant or some other water source—not shown) in predetermined proportions at a foam generator system 70. As is conventional, a transit mixer 51 supplies a concrete pump 53 to supply a suitably designed concrete-water slurry at the job site to produce cellular concrete; the concrete-water slurry transported through a concrete slurry line 55. The foam generator system 70 relies upon a supply of high-pressure air from an air compressor 77 fed through an air line 75. The foam generator 71 is employed to produce stable foam metered such that air content is maintained at 40 to 80 percent of the total volume. The size of the bubbles differs from around 0.1 to 1.5 mm in diameter.

At the foam generator 71, the high-pressure air is directed in a manner to blow bubbles of the liquid foam concentrate 73 suitably diluted with water to create a supply of foam in a foam line 79. Generally, an operator will meter the preformed foam passing down the foam line 79 to supply foam as it is mixed with the concrete-water slurry from the concrete slurry line 55. The density of the preformed foam is typically between 2.5 and 4.0 lb/ft$^3$ (40 and 65 kg/m$^3$). The foam concentrate 73 will have a chemical composition capable of producing and maintaining stable air cells within the PLDCC 99. The air cells formed, thus, should be able to resist the physical and chemical forces imposed during mixing, pumping, placing, and setting of the PLDCC through a PLDCC supply line 83. If the cellular (air-cell) structure is not stable, it may break down under these forces, resulting in an increased concrete density. Most common proprietary formulations of foam concentrate also contain protein hydrolysates or synthetic surfactants.

Low-density cellular concrete may include lightweight aggregates such as vermiculite or perlite. Low-density cellular concrete may also include commercially available fibers, such as nylon, polypropylene, polyester, and alkali-resistant glass, as reinforcing materials. The choice of fiber type depends on performance requirements. Cellular concrete's flexural and tensile strength, impact resistance, fatigue limit, energy absorption, and spalling resistance can be enhanced using fibers that are known to be sufficiently durable under the expected service conditions.

A support system to build up the grade to support a structure is formed of PLDCC for directly supporting the slab structure without the need of installing intermediate or deep foundation systems or using deep ground improvement to stabilize the foundation soils. PLDCC possesses specific factors that make it suitable as a fill for such structures. Thus, to sum up the features which make the use of PLDCC as far more useful for providing foundational support for structures which have the lowest floor elevation which falls beneath the base flood elevation at the building site:

a. High bearing capacity. PLDCC can support structures better than virtually any native soil or compacted fill material.
b. 100% compaction. There is no need to compact the product after placement. The flowable nature of the product will fill all voids.
c. Excavatable. Unlike traditional ready-mix concrete fill products, cellular concrete can be excavated easily with a shovel and/or backhoe. If the application includes the need to dig a trench for placement of plumbing and electrical lines, this can easily be accomplished.

d. Cellular concrete will not break down when exposed to water. Traditional aggregate base materials consist of some fine aggregates that can be washed out over time leaving voids.

e. PLDCC can be made pervious where to do so allows drainage of flood waters. PLDCC can be manufactured in a manner that allows water to pass through it. As properties become susceptible to tidal flooding due to sea level rise, pervious cellular concrete can allow tidal water to pass through while keeping its structural integrity.

f. Extremely light weight. PLDCC can be manufactured at varying densities as low as 20 PCF. Compared to traditional aggregate backfills that weigh approximately 100 PCF, the low weight helps to mitigate potential settlement issues.

g. Low manpower and equipment needed for placement. A single truck is used for placement of the PLDCC and a single delivery of cement to the site will allow to produce more than 100 cubic yards of material.

h. Accelerated placement. Large placements of PLDCC can be performed in a single day. Production rates of 200 cubic yards per hour are possible with properly designed mobile equipment.

i. Competitive cost. Although the material is more expensive (due to the cost of cement) than traditional aggregate base products, the need for less equipment and manpower makes the product competitively priced in place.

In addition, because a support embankment is less dense than traditional embankments, it can be constructed on soil exhibiting lower bearing capacities, thus improving settlement and stability performance of the structure and potentially eliminating costs associated with deep foundation systems. The mass density of the light-weight PLDCC and support embankment embodiments can be significantly less than other conventional geotechnical materials like soil and rock. As such, the support embankment can be more easily constructed atop foundation soils without having to substantially alter soil conditions. This advantage can contribute to the rapid construction of residential structures. For instance, the support embankment can be constructed on softer soils without the support of deep foundation systems as in the prior art, reducing construction time and expenses. In addition, the support embankment can be constructed near buried utilities or nearby structures with less concern about collateral damage.

Regulatory floodplains are defined by the elevation of the base flood in relation to the elevation of the ground. Base flood elevations are used to determine the required elevation of new buildings in the floodplain. Floodplain management will not succeed without accurate measurements of flood elevations, ground elevations, and building elevations. If flood elevations are based on one system and ground or building elevations are based any another, things will not work.

NGVD 29 stands for National Geodetic Vertical Datum of 1929. It is a system that has been used by surveyors and engineers for most of the 20th century. It has been the basis for relating ground and flood elevations, but it has been replaced by the more accurate North American Vertical Datum of 1988 (NAVD 88). The National Geodetic Survey (NGS), the government people responsible for mapping, needed a common, consistent national datum to map the whole country. During the 1920s, NGS established a network of 26 tidal gauges in the United States and Canada. Maps were prepared with elevations based on "mean Sea Level Datum of 1929." In the 1970s, the name was changed to the National Geodetic Vertical Datum (NGVD) of 1929.

Having the BFE for the building side and then comparing the architectural design of the proposed structure to various design constraints allows the engineer to determine the suitable LFE for the structure, and in doing so, determines whether elevating the structure is necessary to comply with local codes or the NFIP regulations. Where elevation is necessary, a sufficient volume of engineered fill will allow erection of a rule-compliant structure. Pursuant to the instant methods, forms are erected to receive a sufficient volume of PLDCC to raise the LFE above the BFE, providing a stable and less dense fill. A further quality of PLDCC is its ability to flow into all hollows within the interior of a configured form, conforming perfectly with the grade, including to fill various subterranean burrows and dens, to supply sufficient stable and complete buildup wherein the PLDCC "slab" serves as engineered fill.

Because the objective in laying the slab using PLDCC is to rapidly, efficiently, and with minimal man hours to erect a suitable foundation slab, modular formwork systems, designed with standardized panels and component items, reduce or limit the need for cutting material on site. This speeds up the overall process and therefore requires less labor on site. Modular formwork can readily conform to the enclosed terrain and, thereby, serve as a form of engineered fill. In the presently preferred embodiment, DUO® system formwork is characterized by its low weight and extremely simple handling. In the instant method, not only is the material used is very innovative, but also the entire concept: with a minimal number of different system components, foundational slabs as well as walls and columns can be easily and efficiently formed with only a minimal number of different system components. The system components, which are often the same, are easy to install by hand. Only a few additional tools are required to complete the process. This system is particularly well-suited for residential construction in that the modular nature of the DUO® system speeds up the shuttering process and ensures a high degree of productivity. Because of its simplicity, use of the system reduces the amount of training necessary for such site personnel employed for construction.

The concept being proposed is to "build a box" underneath a home or other building structure and then build the home over on top of it. PLDCC can be poured at varying thicknesses making it possible to achieve the desired elevation for the structure. For example, if the existing pad is at an elevation of 12' and needed to be 16' to reduce the potential of flooding, a "box" of PLDCC that is slightly larger than the footprint of the house would be poured at a thickness of 4 feet.

A reusable, inter-locking forming system would be used. An example of a forming system that could be used is the DUO® system designed by Peri™. PLDCC sets up like normal concrete and therefore the material would harden in a matter of hours and the formwork could be removed in approximately 24 hours, allowing for other construction operations to continue.

The typical process to manufacture the PLDCC is for the truck to mix the cement and water together and then induce the air entrainment admixture into the mix. The water source used most often is city water supplied through a fire hydrant. There is enough air entrainment admixture in the truck to service the project and additional cement needed is supplied by a truck with a storage vessel where the cement is blown pneumatically into the manufacturing truck.

The main cost for manufacturing and placing PLDCC is the cost of raw materials and more specifically cement. To manufacture a cubic yard of PLDCC requires roughly 420 pounds of cement. The current cost of cement delivered to a project (including freight and taxes) will vary geographically but is in the range of about $175 per ton or 8.75 cents per pound. Air entrainment admixture will cost about $50 per gallon and to produce a cubic yard of PLDCC will require about 16 ounces. The total material costs to produce PLDCC will be in the $45.00 per cubic yard range (assuming raw material costs are stable).

The method, then, is to first determine the BFE for the proposed building site. Then, one must evaluate the proposed structure to determine the suitable LFE associated with the proposed structure. For example, relative to a stem wall foundation, a stem wall foundation can be used to raise the lowest floor above the surrounding grade. After the stem walls have been constructed and extended to the desired elevation, the area enclosed by the stem walls is filled with PLDCC to create a sound slab for construction. Through the placement of the PLDCC as additional fill, the site may be elevated above the BFE. This approach provides freeboard—an additional amount of elevation that helps protect against subsurface flooding and floods that exceed the BFE. Constructing a stem wall foundation and placing this additional fill on the site provide the highest level of flood protection.

Where the structure includes a crawlspace to be beneath the first floor will raise the lowest floor of the structure above the surrounding grade. Openings in the foundation walls are recommended. If flooding reaches the building, the openings allow flood waters to enter the area below the lowest floor and equalize the hydrostatic pressure on the foundation walls. Placing additional fill to a level above the BFE provides freeboard that helps protect against subsurface flooding and floods that exceed the Base Flood. Constructing a crawlspace foundation and placing additional fill on the site provide increased flood protection. Placing additional PLDCC as engineered fill beneath the building to a level above the BFE would provide freeboard and therefore increased flood protection.

Placing the lowest floor of the basement at or above the BFE has the effect of eliminating flood-induced damage up to the BFE. In general, the higher the basement floor is above the BFE, the lower the risk of damage from seepage and hydrostatic pressure caused by flood-related groundwater. Where possible, the basement should be built with its floor at or above the BFE. An added benefit is that floods that exceed the BFE will cause significantly less damage to a structure with this type of basement than to structures with basements whose floors are at greater depths.

While the preferred embodiment of the invention has been illustrated and described, as noted above, many changes can be made without departing from the spirit and scope of the invention. Accordingly, the scope of the invention is not limited by the disclosure of the preferred embodiment.

The invention claimed is:

1. The method for elevating the lowest floor elevation (LFE) of a proposed structure to be built on a selected building site on an existing grade to a height at or above the base flood elevation (BFE) as each term is defined under 44 CFR 60.3, the method comprising:

determining the BFE from the Flood Insurance Rate Map (FIRM) by locating the building site thereon and retrieving the BFE;

determining, based upon the retrieved BFE and the proposed structure, the LFE the proposed structure determines;

determining the height of the existing grade beneath the LFE;

calculate a difference between the BFE and the height of the existing grade beneath the LFE;

constructing a form to contain a volume of permeable lightweight cellular concrete (PLDCC), the volume having a PLDCC height that equals the difference; and pouring sufficient PLDCC to fill the form to form a PLDCC slab, the PLDCC slab having a depth at the LFE equal to or exceeding the PLDCC height.

2. The method of claim 1 wherein pouring further comprises the curing of the PLDCC slab to a state having sufficient rigid strength to support the proposed structure.

3. The method of claim 1, wherein the density of the PLDCC is greater than the density of the water.

4. The method of claim 1, wherein:

the form to contain a volume of permeable lightweight cellular concrete (PLDCC) comprises at least one lightweight material and arranged to support and be positioned upon the existing grade; and the form is operatively connected to the existing grade to define a boundary for the PLDCC slab, the form being anchored by a restraining system including crossmembers which are angularly offset from each other and arranged to limit at least one of lateral and vertical movement as situated on the existing grade.

5. The method of claim 4, wherein the cross-members comprise diagonal cross-members extending between a footing and the PLDCC slab as situated on the existing grade.

6. The method of claim 1, wherein the form has a generally rectangular prismatic shape.

7. The method of claim 1, wherein the form has a generally trapezoidal prismatic shape.

8. The method of claim 1, wherein the PLDCC slab includes a bottom portion positionable on a soft soil.

9. The method of claim 1, wherein the form includes a bottom portion embedded in existing grade.

10. The method of claim 1, further comprising erecting the proposed structure including at least one footing positioned on a top portion of the PLDCC slab.

* * * * *